US008578642B2

(12) United States Patent
Troy et al.

(10) Patent No.: US 8,578,642 B2
(45) Date of Patent: Nov. 12, 2013

(54) DROP-IN HANDGUARD SYSTEM

(75) Inventors: Stephen P. Troy, Lee, MA (US); David A. Hewes, Chesterfield, MA (US)

(73) Assignee: Troy Industries, Inc., West Springfield, MA (US)

( * ) Notice: Subject to any disclaimer, the term of this patent is extended or adjusted under 35 U.S.C. 154(b) by 27 days.

(21) Appl. No.: 13/467,278

(22) Filed: May 9, 2012

(65) Prior Publication Data

US 2012/0324775 A1 Dec. 27, 2012

Related U.S. Application Data

(60) Provisional application No. 61/483,853, filed on May 9, 2011.

(51) Int. Cl.
*F41C 23/16* (2006.01)

(52) U.S. Cl.
USPC ..... 42/71.01

(58) Field of Classification Search
USPC ..... 42/71.01, 72, 73, 74
See application file for complete search history.

(56) References Cited

U.S. PATENT DOCUMENTS

| | | | | | |
|---|---|---|---|---|---|
| 3,075,314 | A * | 1/1963 | Bakker | 42/71.01 |
| 3,090,150 | A * | 5/1963 | Stoner | 42/71.01 |
| 4,536,982 | A * | 8/1985 | Bredbury et al. | 42/71.01 |
| 4,663,875 | A * | 5/1987 | Tatro | 42/71.01 |
| 6,490,822 | B1 * | 12/2002 | Swan | 42/71.01 |
| 6,609,321 | B2 * | 8/2003 | Faifer | 42/71.01 |
| 6,618,976 | B1 * | 9/2003 | Swan | 42/114 |
| 6,694,660 | B1 * | 2/2004 | Davies | 42/75.01 |
| 6,839,998 | B1 * | 1/2005 | Armstrong | 42/71.01 |
| 6,895,708 | B2 * | 5/2005 | Kim et al. | 42/72 |
| 7,216,451 | B1 * | 5/2007 | Troy | 42/72 |
| 7,793,452 | B1 * | 9/2010 | Samson et al. | 42/72 |
| 7,938,055 | B2 * | 5/2011 | Hochstrate et al. | 89/193 |
| 8,046,949 | B1 * | 11/2011 | Daniel | 42/75.02 |
| 2006/0010748 | A1 * | 1/2006 | Stoner et al. | 42/71.01 |
| 2008/0301994 | A1 * | 12/2008 | Langevin et al. | 42/71.01 |
| 2009/0013579 | A1 * | 1/2009 | Fluhr | 42/71.01 |
| 2011/0192066 | A1 * | 8/2011 | Kimmel et al. | 42/71.01 |
| 2012/0186123 | A1 * | 7/2012 | Troy et al. | 42/71.01 |

* cited by examiner

*Primary Examiner* — Bret Hayes
(74) *Attorney, Agent, or Firm* — Parsons & Goltry; Robert A. Parsons; Michael W. Goltry

(57) ABSTRACT

A handguard system for use with a firearm including a tubular body assembly having a rearward end and a forward end, a top handguard portion and a bottom handguard portion. The bottom handguard portion includes a forward tubular portion, a gap extending from the rearward end to the forward tubular portion, a first groove formed in an inner surface thereof and spaced forwardly from the rearward end for receiving tines of a barrel nut therein, and a second groove parallel to the first groove. A clamp assembly is carried by the bottom handguard portion for engaging the barrel nut and securing the bottom handguard portion to the receiver. The top handguard portion is receivable in the gap and including a forward end, a rearward end, and engagement elements for securing the forward end of the top handguard to the bottom handguard portion.

18 Claims, 6 Drawing Sheets

DROP-IN HANDGUARD SYSTEM

CROSS-REFERENCE TO RELATED APPLICATION

This application claims the benefit of U.S. Provisional Patent Application No. 61/483,853, filed 9 May 2011.

FIELD OF THE INVENTION

This invention relates to firearms.

More particularly, the present invention relates to handguards systems for use on firearms.

BACKGROUND OF THE INVENTION

In the field of accessories for firearms, many handguards and rails have been provided in various forms for many existing firearms. Each, have their specific benefits and detriments, but each also typically require removal of existing hardware of the firearm other than just removal of the existing handguard. The required removal of hardware may be temporary to install the handguard or permanent. As an example, M16 type firearms have a forward sight post and a Delta ring assembly. The Delta ring assembly and forward sight post are employed to hold the original handguards in place. When aftermarket handguards are employed, the Delta ring assembly is typically required to be discarded. Additionally, the forward sight post also must be removed and any forward sight provided by the replacement handguard.

It would be highly advantageous, therefore, to remedy the foregoing and other deficiencies inherent in the prior art.

An object of the present invention is to provide a new and improved handguard.

Another object of the present invention is to provide a handguard for firearms that employs existing handguard hardware on the firearm.

SUMMARY OF THE INVENTION

Briefly, to achieve the desired objects and advantages of the instant invention, provided is a handguard system for use with a firearm including an upper receiver, a barrel extending from the upper receiver and terminating in a muzzle, a barrel nut attaching the barrel to the upper receiver, the barrel nut having tines extending radially outwardly from a forward end thereof, a Delta ring assembly movable between a rearward position and a forward position, and a front sight assembly. The handguard system includes a tubular body assembly having a rearward end and a forward end, a top handguard portion and a bottom handguard portion. The bottom handguard portion includes a forward tubular portion, a gap extending from the rearward end to the forward tubular portion, a first transverse circumferential groove formed in an inner surface thereof and spaced forwardly from the rearward end for receiving the tines of the barrel nut therein, and a second transverse circumferential groove parallel to the first groove and formed in the inner surface of the bottom handguard portion intermediate the first groove and the rearward end. A clamp assembly is carried by the bottom handguard portion for engaging the barrel nut and securing the bottom handguard portion to the receiver. The top handguard portion is receivable in the gap and includes a forward end, a rearward end, and engagement elements for securing the forward end of the top handguard to the bottom handguard portion.

In a specific aspect, the engagement element of the top handguard portion includes lugs extending from opposing sides of the forward end of the top handguard portion slidably receivable under corresponding tabs formed on opposing sides the gap of bottom handguard portion rearward of the forward tubular portion. Additionally, the top handguard portion further includes a first transverse circumferential groove formed in an inner surface thereof and spaced forwardly from the rearward end for receiving the tines of the barrel nut therein, and a second transverse circumferential groove parallel to the first groove and formed in the inner surface of the bottom handguard portion intermediate the first groove and the rearward end and a clamp assembly carried by the top handguard portion for engaging the barrel nut and securing the top handguard portion to the receiver.

Each clamp assembly, for the top handguard portion and the bottom handguard portion, includes a clamp element having a body with a beveled end and a heel extending substantially perpendicularly from an opposing end of the body. The clamp element is adjustably positioned within the top handguard portion with the heel extending radially outwardly and received in the first groove of the top handguard portion. A threaded aperture is formed through the body and a fastener is inserted through the relevant handguard portion and received in the threaded aperture.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
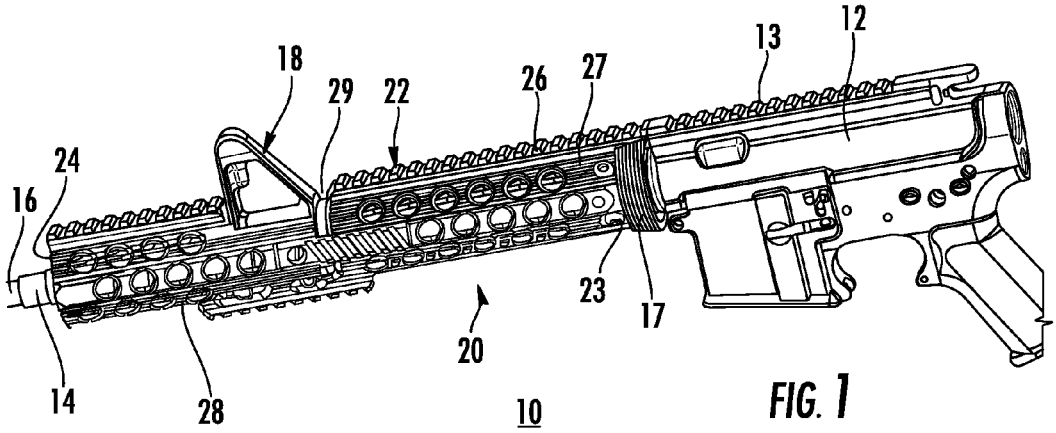
FIG. 1 is a perspective view of a firearm with a drop-in handguard system according to the present invention.

Turning now to the drawings in which like reference characters indicate corresponding elements throughout the several views, attention is directed to FIG. 1 which illustrates a firearm 10, including an upper receiver 12 having a rail 13 formed on an upper surface thereof, a barrel 14 extending from upper receiver 12 and terminating in a muzzle 16, and a drop-in handguard system generally designated 20 coupled thereto. Drop-in handguard system 20 is intended to be used on conventional firearms such as an M16 and the like, without the need to remove the conventional delta ring 17 or front sight assembly 18. Drop-in handguard system 20 includes a tubular body assembly 22 having a rearward end 23 and a forward end 24. A rail 26 can be formed along a top surface of tubular body assembly 22, and configured to align with rail 13 of upper receiver 12 when properly positioned. Other rails can also be provided as desired, such as on the sides or bottom of tubular body assembly 22.

Tubular body assembly 22 includes a top handguard portion 27 and a bottom handguard portion 28. As can be seen, top handguard portion 27 extends from upper receiver 12 to a position rearward of front sight assembly 18.

Bottom handguard portion 28 extends from upper receiver 12 to forward end 24 and includes a forward tubular portion 25 that extends rearwardly from forward end 24 to a position adjacent front sight assembly 18. It will be noted that top handguard portion 27 is configured to correspond to and engage the edges of a gap 29 formed in bottom handguard portion 28, thereby completing tubular body assembly 22. Gap 29 is formed in bottom handguard portion 28 and extends from rearward end 23 and terminates at forward tubular portion 25, spaced from forward end 24. Tubular body assembly 22, when assembled, includes an uncovered forward portion of gap 29 through which front sight assembly 18 extends. Engagement of top handguard portion 27 and bottom handguard portion 28 will be described below.

Figure 2:
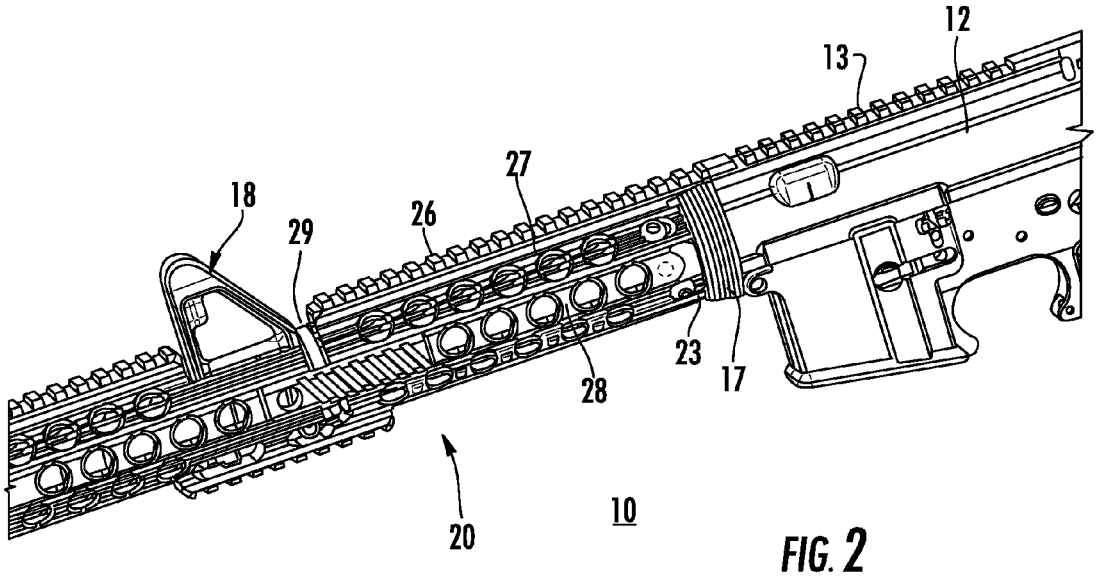
FIG. 2 is a perspective view of the firearm with the drop-in handguard system of FIG. 1 showing the delta ring in the retracted position.

With additional reference to FIG. 2, the operation of delta ring 17 has not been altered, and operates in a manner consistent with a conventional firearm of the type employing a delta ring. The structure of a delta ring and delta ring assembly will not be described, as they are well known in the art. However, it will be understood that the delta ring is biased forwardly by a biasing mechanism (not shown) into an extended position as seen in FIG. 1. Delta ring 17 can be moved rearwardly against the bias to a retracted position as seen in FIG. 2. Delta ring 17 is moved from the extended position to the retracted position to install handguard system 20. With handguard system 20 in position on firearm 10, delta ring 17 overlies rearward end 23 of tubular body assembly 22 in the extended position.

Figure 3:
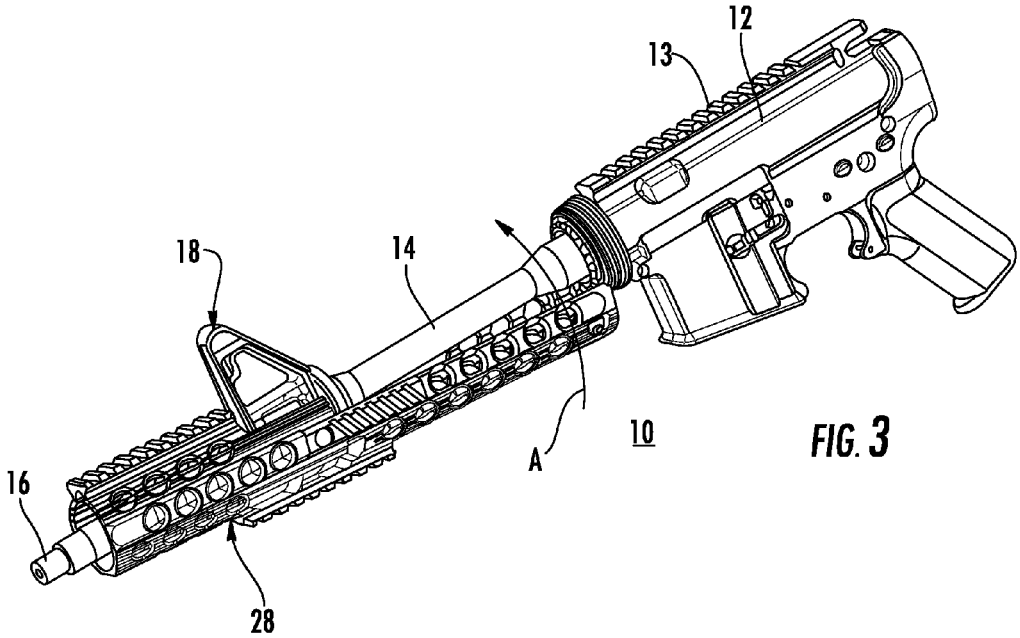
FIG. 3 is a perspective view of the firearm of FIG. 1 showing positioning of the bottom handguard portion.
Figure 4:
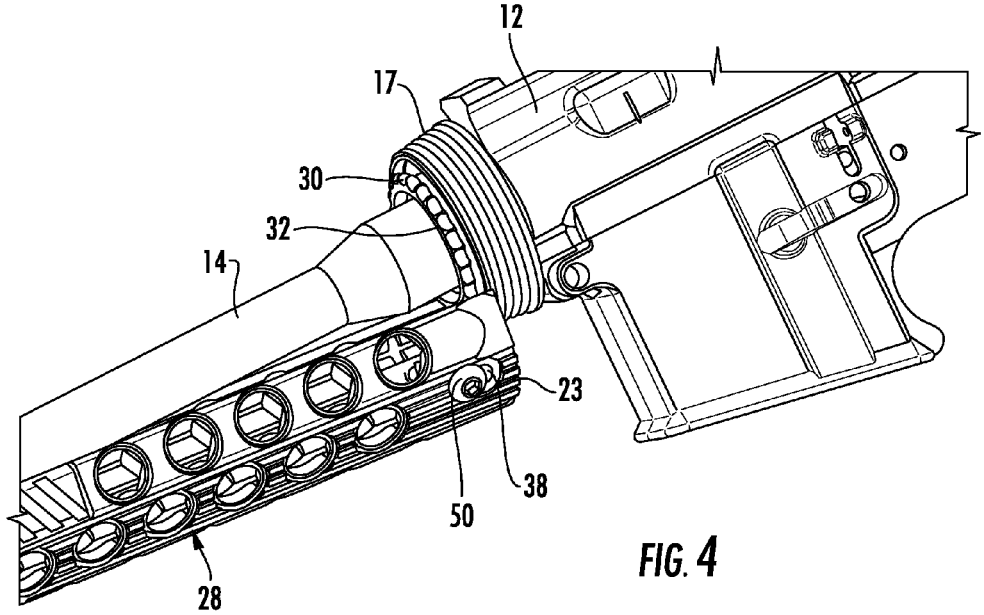
FIG. 4 is an enlarged partial perspective view of the rearward end of the bottom handguard portion of FIG. 3.
Figure 12:
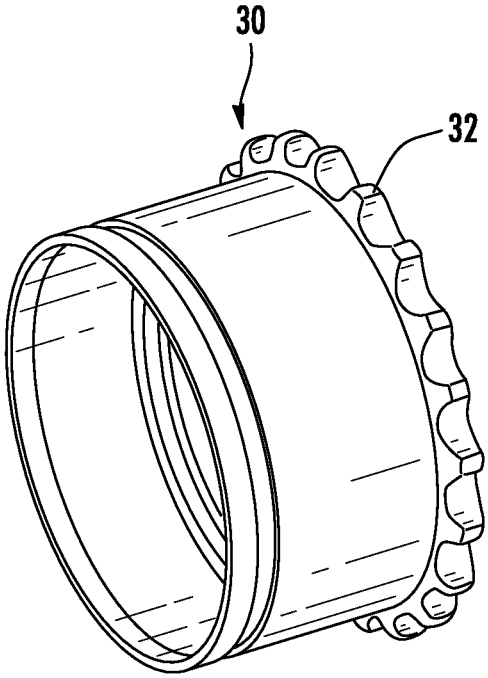
FIG. 12 is a perspective view of a barrel nut.

Turning now to FIGS. 3 and 4, barrel 14 is attached to upper receiver 12 by a barrel nut 30. With momentary reference to FIG. 12, barrel nut 30 is a standard barrel nut and includes tines 32 extending radially outwardly from a forward end thereof. Barrel nut 30 couples barrel 14 to upper receiver 12 in a manner well known to those skilled in the art, and therefore will not be described in detail herein. Additionally, handguard system 20 can be installed without removing barrel nut 30. Delta ring 17 overlies barrel nut 30, but can be moved to the retracted position, as illustrated in FIGS. 3 and 4, to prevent interfering with installation of bottom handguard portion 28. Rearward end 23 of tubular body assembly 22 is positioned over and is coupled to barrel nut 30. This is accomplished by first positioning bottom handguard portion 28 and securing it in place, then positioning top handguard portion 27 and securing it in position.

Figure 5:
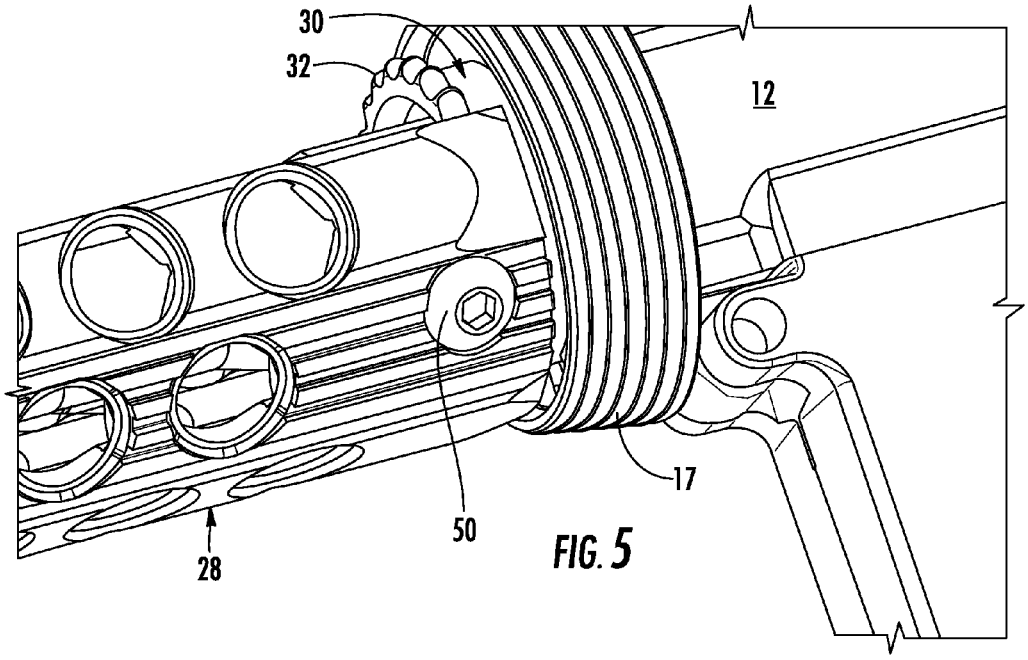
FIG. 5 is an enlarged partial perspective view of the rearward end of the bottom handguard portion of FIG. 3 with the bottom handguard portion in position.
Figure 6:
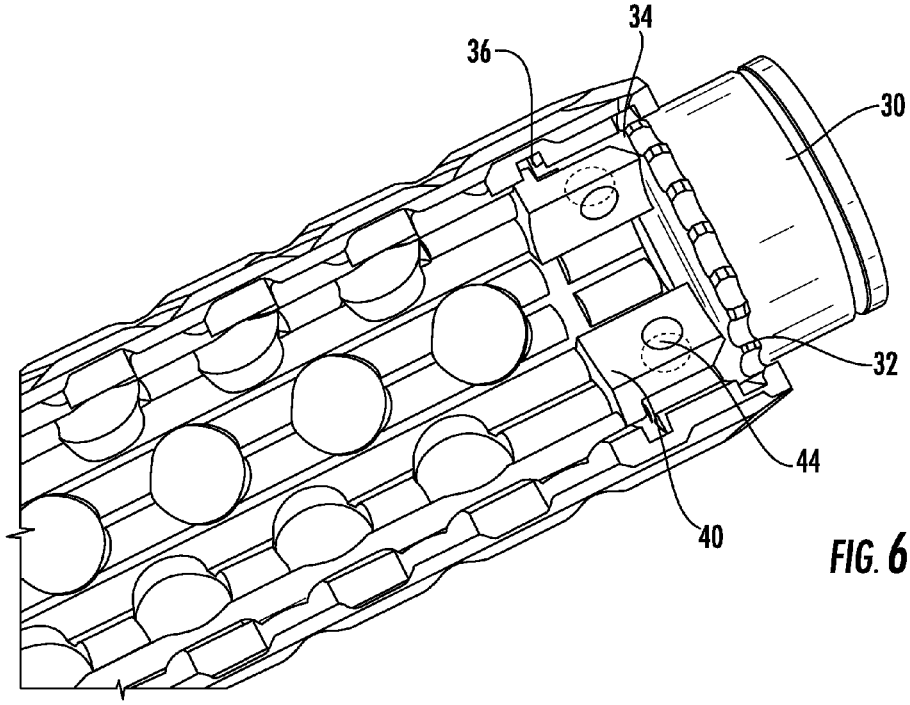
FIG. 6 is an enlarged top perspective view of the rearward end of the bottom handguard portion illustrating the clamping mechanism.

Still referring to FIGS. 3 and 4, with additional reference to FIG. 6, bottom handguard portion 28 is illustrated receiving barrel 14 therethrough and rearward end 23 being received generally radially inwardly by barrel nut 30. Bottom handguard portion 28 is not longitudinally positioned, but generally moved in a direction transverse to the axis of barrel 14 along arrowed line A. The inner surface of bottom handguard portion 28 includes a pair of transverse, spaced apart circumferential grooves 34 and 36, formed spaced forwardly from rearward end 23. When bottom handguard portion 28 is moved radially inwardly toward barrel nut 30, tines 32 are received by groove 34. The forward end of barrel nut 30 and tines 32 are exposed by moving delta ring 17 to the retracted position, providing space for the rearward end of bottom handguard portion 28 as can be seen in FIG. 5.

Figure 11:
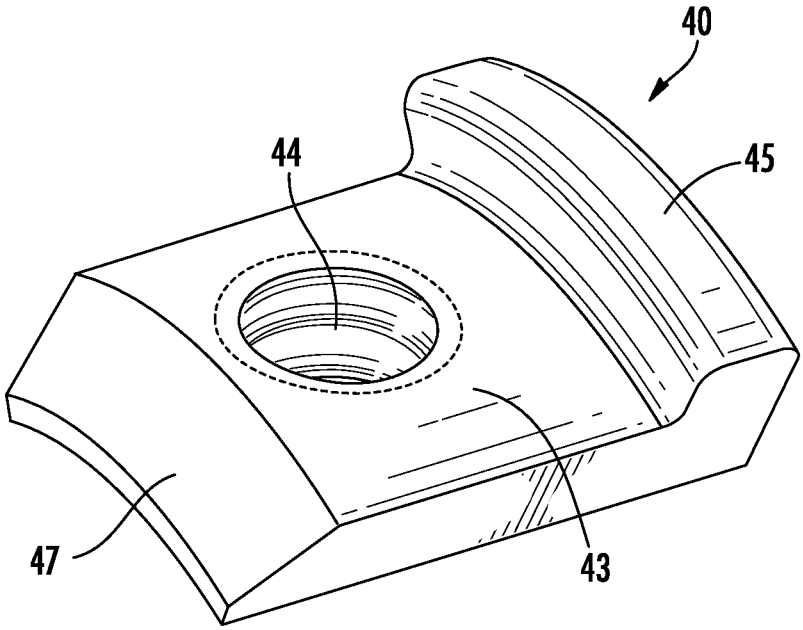
FIG. 11 is a perspective view of a clamp element.

Still referring to FIG. 6, bottom handguard portion 28 is secured in the position illustrated in FIG. 5 by a clamp assembly including two clamp elements 40. More clamp elements can be employed as desired. With momentary reference to FIG. 11, clamp elements 40 each include a body 43 having a threaded aperture 44 therethrough, a heel 45 extending substantially perpendicularly from an end of body 43, and a beveled end 47. Clamp elements 40 are positioned on the inner surface of bottom handguard portion 28 with heels 45 extending radially outwardly and received in groove 36. A fastener, such as a screw 50, is inserted through an aperture 38 formed in bottom handguard portion 28 and received in threaded aperture 44. Aperture 38 is slot shaped to permit clamp element 40 to be moved rearwardly slightly with respect to bottom handguard portion 28 after bottom handguard portion 28 is positioned. This is insure that beveled end 47 contacts barrel nut 30 prior to tightening screw 50, thereby insuring a tight, secure engagement. Clamp elements 40 are positioned prior to positioning bottom handguard portion 28 over barrel nut 30. With bottom handguard portion 28 properly positioned, beveled ends 47 of clamp elements 40 engage barrel nut 30 on an inner edge of the forward end. As screws 50 are tightened, beveled ends 47 push against barrel nut 30 and with heels 45 secure within groove 36, bottom handguard portion 28 is forced forwardly toward muzzle 16. The tension pulls the edges defining groove 34 tightly against the rearward side of tines 32, securing and aligning bottom handguard portion 28.

Figure 7:
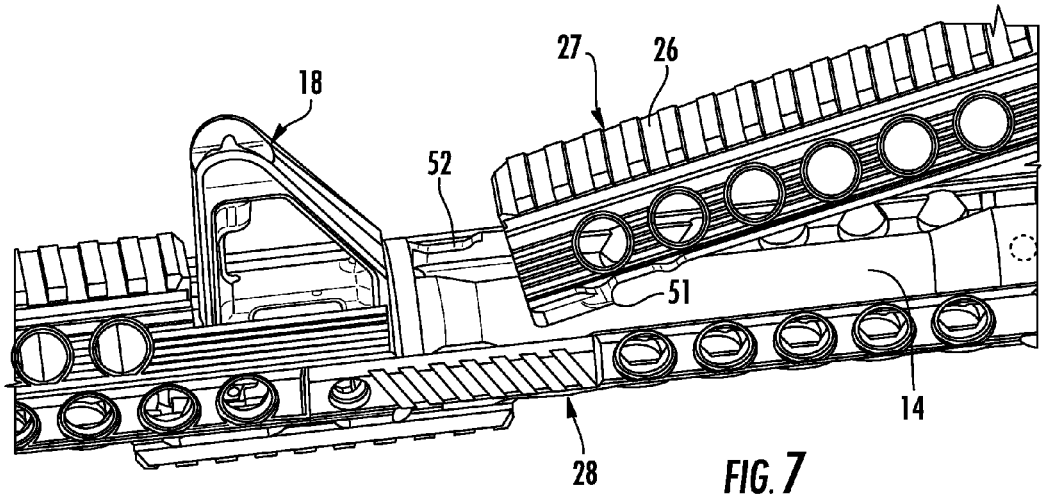
FIG. 7 is an enlarged perspective view of the forward end of the top handguard portion being positioned to engage the bottom handguard portion.
Figure 8:
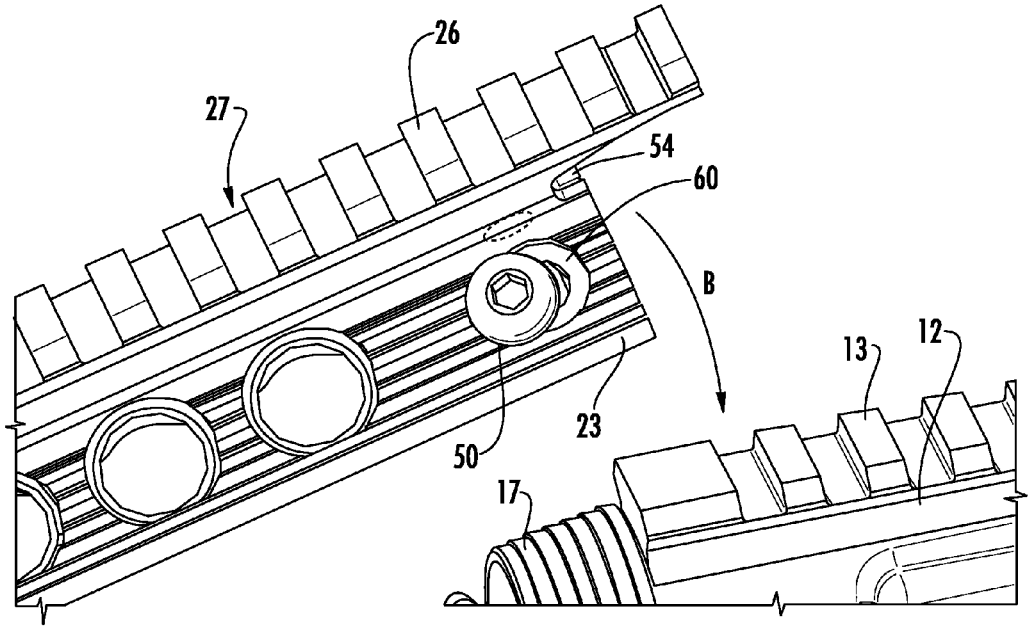
FIG. 8 is an enlarged perspective view of the rearward end of the top handguard portion being positioned.

Turning now to FIGS. 7 and 8, attention is first directed to FIG. 7 illustrating the forward end of top handguard portion 27. Top handguard portion 27 is positioned by sliding lugs 51 extending from opposing side of the forward end of top handguard portion 27 under corresponding tabs 52 formed on opposing sides of bottom handguard portion 28 rearward of space 29. The tongue and groove arrangement of tabs 52 and lugs 51 align top handguard portion 27 with bottom handguard portion 28, and secure the forward end of top handguard portion 27 to bottom handguard portion 28. Turning now to FIG. 8, the rearward end of top handguard portion 27 is then moved transversely inwardly along arrowed line B toward barrel nut 30. The rearward end of top handguard portion 27 includes rail 26 extending rearwardly past rearward end 23 with a longitudinally extending notch 54 formed at the junction of rail 26 and the remaining top handguard portion 27. This enables rail 26 to abut rail 13 of upper receiver 12 without necessitating the removal of delta ring 17. Delta ring 17 is received in notch 54 when in the extended position (FIG. 1).

Figure 9:
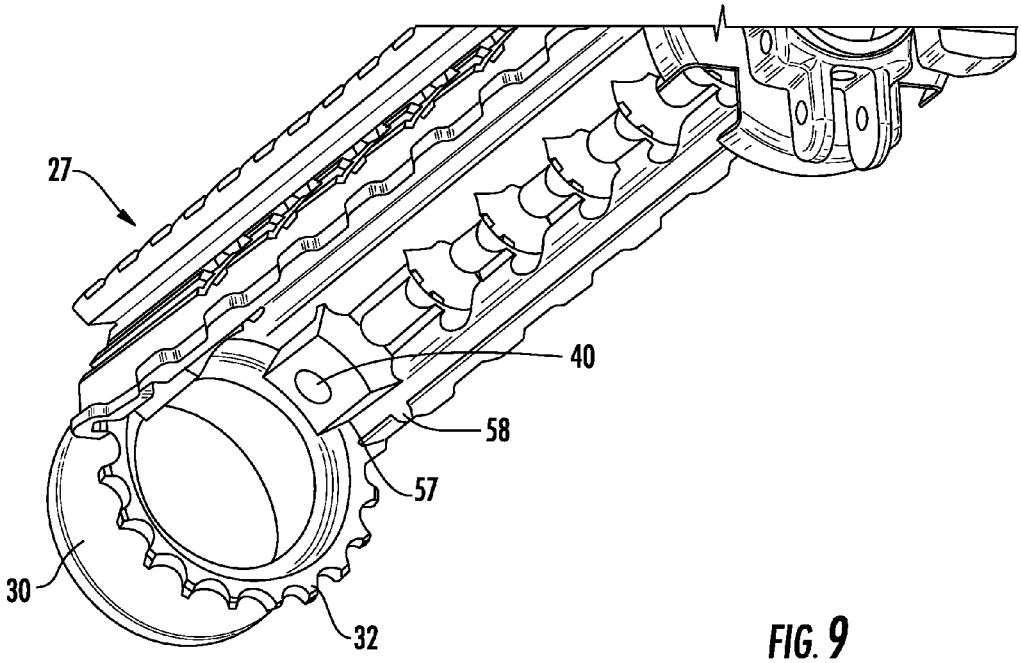
FIG. 9 is a perspective view of the top handguard portion of the drop-in handguard system illustrating the clamping mechanism with barrel nut.
Figure 10:
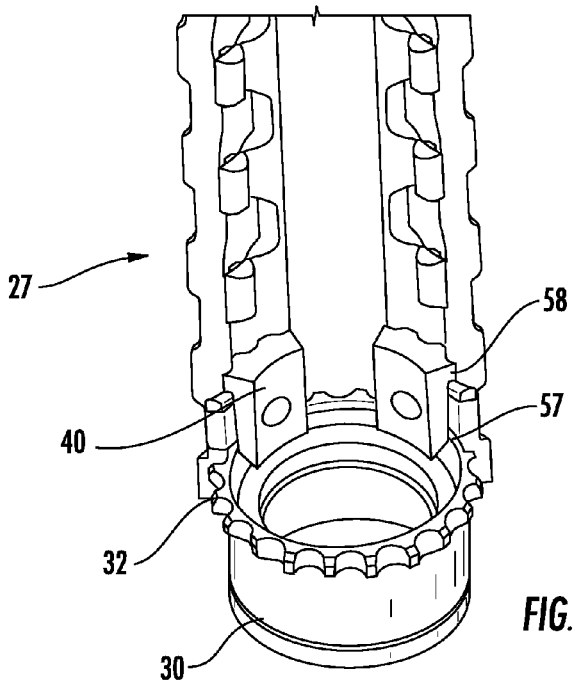
FIG. 10 is a rotated view of FIG. 9.

Referring to FIGS. 9 and 10, the inner surface of top handguard portion 27 includes a pair of transverse, spaced apart circumferential grooves 57 and 58, formed spaced forwardly from rearward end 23. When top handguard portion 27 is moved radially inwardly toward barrel nut 30, tines 32 are received by groove 57. The forward end of barrel nut 30 and tines 32 are exposed by moving delta ring 17 to the retracted position. Top handguard portion 27 is secured in position by a clamp assembly including two clamp elements 40. More clamp elements can be employed as desired. With momentary reference to FIG. 10, clamp elements 40 each include a body 43 having a threaded aperture 44 therethrough, a heel 45 extending substantially perpendicularly from an end of body 43, and a beveled end 47. Clamp elements 40 are positioned on the inner surface of top handguard portion 27 with heels 45 extending radially outwardly and received in groove 58. A fastener, such as a screw 50, is inserted through a slot shaped aperture 60 formed through top handguard portion 27 and received in threaded aperture 44. Aperture 60 is slot shaped to permit clamp element 40 to be moved rearwardly slightly with respect to top handguard portion 27 after top handguard portion 27 is positioned. This is insure that beveled end 47 contacts barrel nut 30 prior to tightening screw 50, thereby insuring a tight, secure engagement. Clamp elements 40 are positioned prior to positioning top handguard portion 27 over barrel nut 30. With top handguard portion 27 properly positioned, beveled ends 47 of clamp elements 40 engage barrel nut 30 on an inner edge of the forward end. As screws 50 are tightened, beveled ends 47 push against barrel nut 30 and with heels 45 secure within groove 58, top handguard portion 27 is forced forwardly toward muzzle 16. The tension pulls the edges defining groove 57 tightly against the rearward side of tines 32, securing and aligning top handguard portion 27. Referring back to FIG. 1, it can be seen that when top handguard portion 27 and bottom handguard portion 28 are positioned and secured to barrel nut 30, delta ring 17 can be released to move to the extended position overlying end 23 of tubular body assembly 22 and received within notch 54.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A handguard system for use with a firearm including an upper receiver, a barrel extending from the upper receiver and terminating in a muzzle, a barrel nut attaching the barrel to the upper receiver, the barrel nut having tines extending radially outwardly from a forward end thereof, a Delta ring assembly movable between a rearward position and a forward position, and a front sight assembly, the handguard system comprising:

a tubular body assembly having a rearward end and a forward end, a top handguard portion and a bottom handguard portion;

the bottom handguard portion includes a forward tubular portion, a gap extending from the rearward end to the forward tubular portion, a first transverse circumferential groove formed in an inner surface thereof and spaced forwardly from the rearward end for receiving the tines of the barrel nut therein, and a second transverse circumferential groove parallel to the first groove and formed in the inner surface of the bottom handguard portion intermediate the first groove and the rearward end;

a clamp assembly carried by the bottom handguard portion for engaging the barrel nut and securing the bottom handguard portion to the receiver; and the top handguard portion receivable in the gap and including a forward end, a rearward end, and engagement elements for securing the forward end of the top handguard to the bottom handguard portion.

2. A handguard system as claimed in claim 1 wherein the engagement element of the top handguard portion includes lugs extending from opposing sides of the forward end of the top handguard portion slidably receivable under corresponding tabs formed on opposing sides the gap of bottom handguard portion rearward of the forward tubular portion.

3. A handguard system as claimed in claim 2 wherein the rearward end of top handguard portion includes a rail extending rearwardly past the rearward end with a longitudinally extending notch formed at the junction of the rail and top handguard portion for receiving the delta ring in the forward position.

4. A handguard system as claimed in claim 1 wherein the top handguard portion further includes a first transverse circumferential groove formed in an inner surface thereof and spaced forwardly from the rearward end for receiving the tines of the barrel nut therein, and a second transverse circumferential groove parallel to the first groove and formed in the inner surface of the bottom handguard portion intermediate the first groove and the rearward end and a clamp assembly carried by the top handguard portion for engaging the barrel nut and securing the top handguard portion to the receiver.

5. A handguard system as claimed in claim 4 wherein the clamp assembly includes a clamp element having a body with a beveled end and a heel extending substantially perpendicularly from an opposing end of the body, the clamp element adjustably positioned within the top handguard portion with the heel extending radially outwardly and received in the first groove of the top handguard portion.

6. A handguard system as claimed in claim 5 wherein the clamp element further includes a threaded aperture formed through the body and a fastener inserted through the top handguard portion and received in the threaded aperture.

7. A handguard system as claimed in claim 1 wherein the clamp assembly includes a clamp element having a body with a beveled end and a heel extending substantially perpendicularly from an opposing end of the body, the clamp element adjustably positioned within the bottom handguard portion with the heel extending radially outwardly and received in the first groove of the bottom handguard portion.

8. A handguard system as claimed in claim 7 wherein the clamp element further includes a threaded aperture formed through the body and a fastener inserted through the bottom handguard portion and received in the threaded aperture.

9. A handguard system as claimed in claim 8 wherein the clamp assembly further includes a second clamp element having a body with a beveled end and a heel extending substantially perpendicularly from an opposing end of the body, adjustably positioned within the bottom handguard portion with the heel extending radially outwardly and received in the first groove.

10. A firearm comprising:

a receiver;

a barrel extending from the receiver and terminating in a muzzle;

a barrel nut affixing the barrel to the receiver, the barrel nut having radially outwardly directed tines spaced about an outer periphery thereof;

a Delta ring assembly overlying the barrel nut and movable between a rearward position exposing the barrel nut and a forward position;

a front sight assembly carried by the barrel;

a tubular body assembly having a rearward end and a forward end, a top handguard portion and a bottom handguard portion;

the bottom handguard portion includes a forward tubular portion, a gap extending from the rearward end to the forward tubular portion, a first transverse circumferential groove formed in an inner surface thereof and spaced forwardly from the rearward end, the tines of the barrel nut received therein, and a second transverse circumferential groove parallel to the first groove and formed in the inner surface of the bottom handguard portion intermediate the first groove and the rearward end;

a clamp assembly carried by the bottom handguard portion and engaging the barrel nut to secure the bottom handguard portion to the receiver; and the top handguard portion received in the gap and including a forward end, a rearward end, and engagement elements securing the forward end of the top handguard to the bottom handguard portion.

11. A firearm as claimed in claim 10 wherein the engagement element of the top handguard portion includes lugs extending from opposing sides of the forward end of the top handguard portion slidably received under corresponding tabs formed on opposing sides the gap of bottom handguard portion rearward of the forward tubular portion.

12. A firearm as claimed in claim 11 wherein the rearward end of top handguard portion includes a rail extending rearwardly past the rearward end with a longitudinally extending notch formed at the junction of the rail and top handguard portion receiving the delta ring in the forward position.

13. A firearm as claimed in claim 10 wherein the top handguard portion further includes a first transverse circumferential groove formed in an inner surface thereof and spaced forwardly from the rearward end, the tines of the barrel nut received therein, and a second transverse circumferential groove parallel to the first groove and formed in the inner surface of the top handguard portion intermediate the first groove and the rearward end and a clamp assembly carried by the top handguard portion engaging the barrel nut and securing the top handguard portion to the receiver.

14. A firearm as claimed in claim 13 wherein the clamp assembly includes a clamp element having a body with a beveled end engaging the barrel nut and a heel extending substantially perpendicularly from an opposing end of the body, the clamp element adjustably positioned within the top handguard portion with the heel extending radially outwardly and received in the first groove of the top handguard portion.

15. A firearm as claimed in claim 14 wherein the clamp element further includes a threaded aperture formed through the body and a fastener inserted through the top handguard portion and received in the threaded aperture.

16. A firearm as claimed in claim 10 wherein the clamp assembly includes a clamp element having a body with a beveled end engaging the barrel nut and a heel extending substantially perpendicularly from an opposing end of the body, the clamp element adjustably positioned within the bottom handguard portion with the heel extending radially outwardly and received in the first groove of the bottom handguard portion.

17. A firearm as claimed in claim 16 wherein the clamp element further includes a threaded aperture formed through the body and a fastener inserted through the bottom handguard portion and received in the threaded aperture.

18. A firearm as claimed in claim 17 wherein the clamp assembly further includes a second clamp element having a body with a beveled end engaging the barrel nut and a heel extending substantially perpendicularly from an opposing end of the body, adjustably positioned within the bottom handguard portion with the heel extending radially outwardly and received in the first groove.

* * * * *